US008701397B2

(12) United States Patent
Tanaka et al.

(10) Patent No.: US 8,701,397 B2
(45) Date of Patent: Apr. 22, 2014

(54) OPERATING OIL SUPPLYING DEVICE AND CONSTRUCTION MACHINE

(75) Inventors: Satoshi Tanaka, Oyama (JP); Norihide Mizoguchi, Kitakatsusika-gun (JP)

(73) Assignee: Komatsu Ltd., Tokyo (JP)

( * ) Notice: Subject to any disclaimer, the term of this patent is extended or adjusted under 35 U.S.C. 154(b) by 410 days.

(21) Appl. No.: 12/933,982

(22) PCT Filed: Mar. 5, 2009

(86) PCT No.: PCT/JP2009/054214

§ 371 (c)(1),
(2), (4) Date: Sep. 22, 2010

(87) PCT Pub. No.: WO2009/119277

PCT Pub. Date: Oct. 1, 2009

(65) Prior Publication Data

US 2011/0011076 A1 Jan. 20, 2011

(30) Foreign Application Priority Data

Mar. 25, 2008 (JP) ..... 2008-078236

(51) Int. Cl.
*F15B 11/02* (2006.01)

(52) U.S. Cl.
USPC ..... 60/329; 60/421; 60/422; 60/429; 60/456

(58) Field of Classification Search
USPC ..... 60/396, 329, 420, 421, 422, 428, 429, 60/445, 446, 456, 484, 486, 516, 469; 92/5 R
See application file for complete search history.

(56) References Cited

U.S. PATENT DOCUMENTS

| | | | | |
|---|---|---|---|---|
| 3,952,510 | A | 4/1976 | Peterson | |
| 3,972,185 | A | 8/1976 | Medina | |
| 4,083,469 | A | 4/1978 | Schexnayder | |
| 4,586,330 | A * | 5/1986 | Watanabe et al. | 60/421 |
| 6,076,488 | A | 6/2000 | Yamagishi | |
| 6,179,570 | B1 | 1/2001 | Smith | |
| 6,195,989 | B1 * | 3/2001 | Hall et al. | 60/329 |

(Continued)

FOREIGN PATENT DOCUMENTS

| | | | |
|---|---|---|---|
| DE | 19753915 | A1 | 6/1998 |
| DE | 102006024731 | B3 | 8/2007 |

(Continued)

OTHER PUBLICATIONS

Office Action issued Apr. 10, 2012 in Japanese Patent Application No. 2008-078236 with partial English translation, 5 pages.

(Continued)

*Primary Examiner* — Edward Look
*Assistant Examiner* — Logan Kraft
(74) *Attorney, Agent, or Firm* — Fish & Richardson P.C.

(57) ABSTRACT

A hydraulic oil supply device includes: a work equipment pump that supplies a hydraulic oil to a hydraulic actuator that drives a work equipment; a fan pump that supplies the hydraulic oil to a hydraulic motor that drives a cooling fan; and a circuit switching valve provided on a hydraulic circuit being branched from a hydraulic circuit connecting the hydraulic actuator with the work equipment pump to be connected to the fan pump, the circuit switching valve selectively connecting a discharge portion of the fan pump to the hydraulic actuator and the hydraulic motor.

18 Claims, 8 Drawing Sheets

(56) References Cited

U.S. PATENT DOCUMENTS

| | | | | |
|---|---|---|---|---|
| 6,286,308 | B1 | 9/2001 | Yoshida et al. | |
| 6,311,488 | B1 | 11/2001 | Maruta et al. | |
| 6,848,255 | B2 | 2/2005 | Chiaramonte | |
| 7,849,688 | B2 * | 12/2010 | Dvorak et al. | 60/456 |
| 8,146,356 | B2 * | 4/2012 | Leidinger et al. | 60/429 |
| 2007/0193262 | A1 * | 8/2007 | Iwamoto | 60/421 |
| 2008/0034746 | A1 | 2/2008 | Verkuilen | |
| 2009/0107133 | A1 | 4/2009 | Leidinger et al. | |

FOREIGN PATENT DOCUMENTS

| | | | |
|---|---|---|---|
| JP | 658263 | A | 3/1994 |
| JP | 6066141 | A | 3/1994 |
| JP | 949427 | A | 2/1997 |
| JP | 1068142 | A | 3/1998 |
| JP | 10184355 | A | 7/1998 |
| JP | 2000130164 | A | 5/2000 |
| JP | 2000161060 | A | 6/2000 |
| JP | 2001003385 | A | 1/2001 |
| JP | 2001020869 | A | 1/2001 |
| JP | 2001329568 | A | 11/2001 |
| JP | 2004251120 | A | 9/2004 |
| JP | 2004-316682 | A | 11/2004 |
| JP | 2005098346 | A * | 4/2005 |
| JP | 2005147257 | A | 6/2005 |
| JP | 2005207067 | A | 8/2005 |
| JP | 2006009833 | A | 1/2006 |
| JP | 2007046761 | A | 2/2007 |
| JP | 2007182710 | A | 7/2007 |
| JP | 2008267565 | A | 11/2008 |

OTHER PUBLICATIONS

Supplementary European Search Report issued in EP Application No. 09 72 3761 on Oct. 15, 2012, 5 pages.

International Search Report issued May 26, 2009 in International Application No. PCT/JP2009/054214.

* cited by examiner

OPERATING OIL SUPPLYING DEVICE AND CONSTRUCTION MACHINE

CROSS REFERENCE TO RELATED APPLICATIONS

This application claims priority to Application No. PCT/JP2009/05214 filed on Mar. 5, 2009, which application claims priority to Application No. JP 2008-078236 filed on Mar. 25, 2008. The entire contents of both applications are incorporated herein by reference in their entireties.

TECHNICAL FIELD

The invention relates to a hydraulic oil supply device and a construction machine.

BACKGROUND ART

In a construction machine, a hydraulic motor is used to drive a cooling fan for cooling an engine and the like, and a hydraulic actuator is used to drive a work equipment of a dump truck, namely a body (often referred to as a hoist or a vessel), or a work equipment of a hydraulic excavator or a wheel loader. For driving the fan and the work equipment, since the usage and required characteristics thereof are different, a hydraulic circuit for driving the fan and a hydraulic circuit for driving the work equipment are generally separately provided and each hydraulic circuit has a hydraulic pump.

Since the fan is smaller in size and lighter in weight as compared with the work equipment, a small-sized hydraulic pump with a relatively small pump displacement is employed as the hydraulic pump used for driving the fan (hereinafter referred to as a fan pump). In contrast, since a relatively large amount of a hydraulic oil needs to be supplied for driving the work equipment as compared with the hydraulic motor for driving the fan, or the like, a large-sized hydraulic pump with a relatively large pump displacement is employed as the hydraulic pump for driving the work equipment (hereinafter referred to as a work equipment pump). Such a large-sized hydraulic pump requires a high production cost and a large location space. Accordingly, a size reduction of the work equipment pump has been desired.

As for the structure of the hydraulic circuit for driving the fan and the hydraulic circuit for driving the work equipment, it is known in a hydraulic excavator provided with a fan pump and a turning pump for supplying a hydraulic oil to a turning motor that turns the work equipment that a hydraulic oil flow path is switched to supply the hydraulic oil from the turning pump to a hydraulic motor for driving the fan (for instance, see Patent Document 1).

[Patent Document 1] JP-A-2007-46761

DISCLOSURE OF THE INVENTION

Problem to be Solved by the Invention

According to Patent Document 1, whose object is directed to improvement of the cleanability of a fan, the hydraulic oil from the turning pump is supplied to the hydraulic motor for driving the fan. In other words, it is not possible to supply the hydraulic oil from the hydraulic motor for driving the fan to the turning pump, and of course not possible to supply the hydraulic oil to a work equipment pump. For this reason, it is inevitable to supply the hydraulic oil by the work equipment pump alone in order to drive the work equipment, and therefore a conventional large-sized pump has to be employed as the work equipment pump, which increases the costs of the whole hydraulic oil supply device. Further, the flexibility of layout is lowered since the work equipment pump requires a large location space.

An object of the invention is to provide a hydraulic oil supply device capable of reducing costs and improving the flexibility of layout while maintaining the movement performance of a work equipment and a construction machine provided with the hydraulic oil supply device.

Means for Solving the Problems

According to an aspect of the invention, a hydraulic oil supply device is installed in a construction machine to supply a hydraulic oil to a work equipment of the construction machine, the hydraulic oil supply device including: a work equipment pump that supplies the hydraulic oil to a hydraulic actuator that drives the work equipment; a fan pump that supplies the hydraulic oil to a hydraulic motor that drives a cooling fan; and a circuit switching valve provided on a hydraulic circuit being branched from a hydraulic circuit connecting the hydraulic actuator with the work equipment pump to be connected to the fan pump, the circuit switching valve selectively connecting a discharge portion of the fan pump to the hydraulic actuator and the hydraulic motor.

The hydraulic oil supply device includes the circuit switching valve that selectively connects the discharge portion of the fan pump to the hydraulic actuator that drives the work equipment and the hydraulic motor that drives the cooling fan. With this arrangement, since the hydraulic actuator for the work equipment is connected to the discharge portion of the fan pump by switching the circuit switching valve, the hydraulic oil from the fan pump can be supplied to the work equipment. Thus, the work equipment is supplied not only with the hydraulic oil from the work equipment pump but also with the hydraulic oil from the fan pump. Since the supply amount of the hydraulic oil is increased, the movement speed of the work equipment can be improved.

In addition, since the hydraulic oil is also supplied from the fan pump, the pump size of the work equipment pump can be reduced by the displacement of the fan pump while maintaining the movement performance of the work equipment. Thus, the costs of the whole hydraulic oil supply device can be reduced.

In addition, since the pump size of the work equipment pump can be reduced, the flexibility of layout can be improved.

The hydraulic oil supply device according to the aspect of the invention preferably includes a control body for operating a movement of the work equipment; a movement position detector for detecting a movement position of the work equipment; and a controller that switches the circuit switching valve based on an operation signal output from the control body and a detection signal of the movement position detector.

In the hydraulic oil supply device, the circuit switching valve is switched based on the operation signal output from the control body for operating the work equipment and the detection signal of the movement position detector for detecting the movement position of the work equipment. In this manner, since the movement condition of the work equipment can be accurately determined, when it is not necessary to switch the circuit depending on the movement condition of the work equipment, the circuit switching valve can be prevented from being switched. Since unnecessary circuit switching can be avoided, the cooling efficiency of the fan is not reduced.

In the hydraulic oil supply device according to the aspect of the invention, it is preferable that the controller should switch the circuit switching valve after minimizing the pump displacement of the fan pump.

In the hydraulic oil supply device, since the circuit switching valve is switched after the pump displacement of the fan pump is minimized, the circuit switching valve can be switched while the discharge pressure of the fan pump is reduced. Thus, generation of an instant increase in the pressure of the hydraulic oil (so-called peak pressure) upon switching the circuit can be prevented. In particular, since the oil pressure of the hydraulic actuator that drives the work equipment is considerably high when the work equipment starts to be driven and gradually decreases thereafter, delaying the timing of the circuit switching as described above in addition to reducing the discharge pressure of the fan pump in switching of the circuit significantly can contribute to preventing generation of the peak pressure.

The hydraulic oil supply device according to the aspect of the invention preferably includes a temperature sensor that detects at least one of temperatures of the hydraulic oil and a cooling water, in which the controller prohibits switching of the circuit switching valve based on a detection signal of the temperature sensor and the detection signal of the movement position detector.

In the hydraulic oil supply device, switching the circuit switching valve is prohibited based on the detection signal of the temperature sensor that detects the temperature of the hydraulic oil or the cooling water and the detection signal of the movement position detector that detects the movement position of the work equipment. With this arrangement, when the circuit should not be switched because of the high temperature of the hydraulic oil or the cooling water, or when the circuit does not need to be switched, for instance, because the movement of the work equipment is suspended on the way or is highly frequently stopped, switching the circuit can be prohibited. Thus, it is possible to prioritize supply of the hydraulic oil from the fan pump to the fan motor when cooling by the cooling fan is required, and therefore the circuit can be prevented from being unnecessarily switched when circuit switching is not required even when the temperature of the hydraulic oil or the cooling water is within an acceptable range. Accordingly, the circuit can be switched in an appropriate manner without reducing the cooling efficiency of the cooling fan.

The hydraulic oil supply device according the aspect of the invention preferably includes an accelerator pedal angle sensor that detects an accelerator pedal angle for operating an output of an engine, in which the controller switches the circuit switching valve based on the operation signal of the control body, the detection signal of the movement position detector, and a detection signal of the accelerator pedal angle sensor.

In the hydraulic oil supply device, the circuit switching valve is switched based on the operation signal of the control body, the detection signal of the movement position detector, and a detection signal of the accelerator pedal angle sensor. Here, in order to increase the speed of an engine that drives the work equipment pump for increasing the movement speed of the work equipment, an operator increases the accelerator pedal angle. Since the accelerator pedal angle is taken into consideration, necessity for increasing the movement speed of the work equipment can be determined with higher accuracy. Thus, when circuit switching is not required, the circuit can be effectively prevented from being unnecessarily switched, thereby further preventing a reduction in the cooling efficiency of the cooling fan.

The hydraulic oil supply device according to the aspect of the invention preferably includes an engine speed sensor that detects an engine speed, in which the controller switches the circuit switching valve based on the operation signal of the control body, the detection signal of the movement position detector, and a detection signal of the engine speed sensor.

In the hydraulic oil supply device, the circuit switching valve is switched based on the operation signal of the control body, the detection signal of the movement position detector, and the detection signal of the engine speed sensor. Here, in order to increase the movement speed of the work equipment, an operator increases the accelerator pedal angle to increase the speed of an engine that drives the work equipment pump. Since the engine speed is taken into consideration, necessity for increasing the movement speed of the work equipment can be determined with higher accuracy. Thus, the reduction in the cooling efficiency of the cooling fan can be more effectively prevented in the same manner as in one of the above hydraulic oil supply devices.

According to an aspect of the invention, a construction machine includes: a hydraulic actuator that drives a work equipment; a hydraulic motor that drives a cooling fan; and one of the above hydraulic oil supply devices.

With the construction machine according to the aspect of the invention, a construction machine capable of attaining the advantages of the above hydraulic oil supply device can be provided.

BEST MODE FOR CARRYING OUT THE INVENTION

Figure 1:
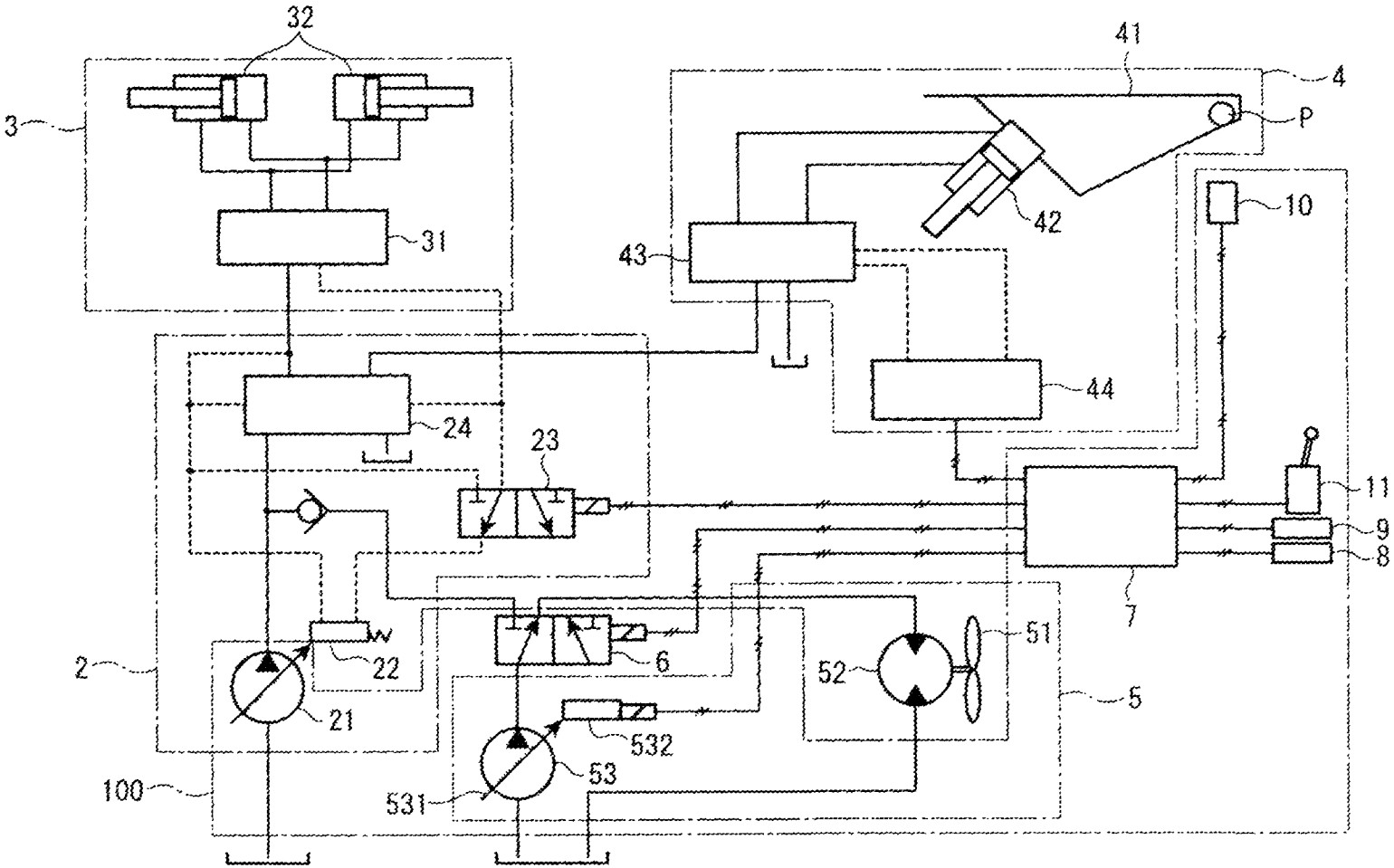
FIG. 1 is a diagram showing a structure of a construction machine according to a first exemplary embodiment of the invention.

Embodiments of the invention will be described below with reference to the drawings. Incidentally, in the below-described second and the subsequent exemplary embodiments, like reference numerals are attached to the same components as those in the following first exemplary embodiment to omit the explanation thereof.

First Exemplary Embodiment

[1-1] Whole Structure of Dump Truck 1

In FIG. 1 schematically showing the structure of a dump truck (construction machine) 1 according to a first exemplary embodiment, the dump truck 1 includes: a hydraulic oil supply amount adjuster 2; a steering mechanism driver 3; a work equipment driver 4; a fan driver 5; a circuit switching valve 6; and a controller 7.

The hydraulic oil supply amount adjuster 2 is a portion for adjusting the supply amount of a hydraulic oil supplied to the steering mechanism driver 3 and the work equipment driver 4. The hydraulic oil supply amount adjuster 2 includes: a work equipment pump 21; a load-sensing valve 22; a pilot pressure switching valve 23; and a priority valve 24. The work equipment pump 21 is a variable displacement hydraulic pump that is driven by an engine (not shown) as a power source and its discharge amount changes in accordance with the valve position of the load-sensing valve 22. The pilot pressure switching valve 23 is a position switching valve for switching the discharge amount of the work equipment pump 21 to the maximum flow rate. A solenoid of the pilot pressure switching valve 23 is energized in response to a control command from the controller 7, thereby switching the valve position. A hydraulic oil from the work equipment pump 21 is divided between the steering mechanism driver 3 and the work equipment driver 4 via the priority valve 24. At this time, the priority valve 24 preferentially supplies the hydraulic oil to the steering mechanism driver 3 in accordance with a difference in the pressures of pilot lines.

The steering mechanism driver 3 is a portion for driving a steering mechanism (not shown) in accordance with the steering operation of an operator. The steering mechanism driver 3 includes a steering valve 31 and a steering cylinder 32. The valve position of the steering valve 31 is switchable in accordance with the rotation angle and rotation speed of a steering wheel. The steering cylinder 32 drives the steering mechanism in accordance with the flow rate of the hydraulic oil supplied from the work equipment pump 21 and the valve position of the steering valve 31.

The work equipment driver 4 is configured for an unloading operation of earth and sand or the like. The work equipment driver 4 includes: a body (work equipment) 41; a hoist cylinder 42; a hoist valve 43; and a body control solenoid valve 44. The body 41 is a truck bed on which earth and sand is loaded and is supported to a vehicle body frame (not shown) of the dump truck 1 for a relative up-down movement. The hoist cylinder (hydraulic actuator) 42 couples the body 41 and the vehicle body frame. Both the ends of the hoist cylinder 42 are rotatably supported to the body 41 and the vehicle body frame, respectively. The hoist cylinder 42 is driven by the hydraulic oil supplied from the work equipment pump 21 and is elongated/shrunk in accordance with switching the valve position of the hoist valve 43. The hoist valve 43 is switchable to respective positions associated with "down", "float", "hold" and "up" of the body 41 by the body control solenoid valve 44 and the hoist cylinder 42 is elongated/shrunk to cause the up-down movement of the body 42 relative to the vehicle body frame.

The fan driver 5 is a portion for driving a cooling fan (hereinafter referred to simply as a fan) 51. The fan driver 5 includes: a hydraulic fan motor (hydraulic motor) 52; and a fan pump 53. An output shaft of the fan motor 52 is provided with the fan 51, and therefore the fan 51 is rotated by driving the fan motor 52. The fan motor 52 and the fan pump 53 are hydraulically connected to each other via the circuit switching valve 6. The rotation speed of the fan motor 52 changes in accordance with the discharge amount of the fan pump 53. The fan pump 53 is a variable displacement hydraulic pump that is driven by an engine as a power source. The fan pump 53 includes: a displacement changer 531 such as a swash plate that changes a pump displacement; and a regulator 532 such as a solenoid valve that drives the displacement changer 531. When the regulator 532 drives the displacement changer 531 in response to a control command from the controller 7, the pump displacement changer 531 changes the pump displacement, thereby changing the discharge amount of the fan pump 53 by switching the valve position of the circuit switching valve 6.

The circuit switching valve 6 is a direction switching valve whose valve position is switched by energizing a solenoid and is provided on a hydraulic circuit that is branched from a hydraulic circuit connecting the steering cylinder 32 and the hoist cylinder 42 to the work equipment pump 21 to be connected to the fan pump 53. The hydraulic oil from the fan pump 53 is selectively supplied to the steering cylinder 32 and the hoist cylinder 42 and to the fan motor 52.

The controller 7 is configured as a unit for controlling the flow rates of the hydraulic oil in the hydraulic oil supply amount adjuster 2, the steering mechanism driver 3 and the work equipment driver 4 to generate and output control commands to the pilot pressure switching valve 23, the body control solenoid valve 44, a regulator 532 and the circuit switching valve 6. Thus, the input-side of the controller 7 is electrically connected to each of a water temperature sensor (temperature sensor) 8 for detecting the temperature of a cooling water, an oil temperature sensor (temperature sensor) 9 for detecting the temperature of the hydraulic oil, a movement position detector 10 such as a potentiometer provided at a support shaft P of the body 41 to detect the movement position of the body 41, and a body control lever (control body) 11 for operating the body 41. The output-side of the controller 7 is electrically connected to each of the pilot pressure switching valve 23, the body control solenoid valve 44, the regulator 532 and the circuit switching valve 6.

In the dump truck 1 of the above arrangement, a hydraulic oil supply device 100 is provided with the work equipment pump 21, the fan pump 53, the circuit switching valve 6, the controller 7, the water temperature sensor 8, the oil temperature sensor 9, the movement position detector 10 and body control lever 11. The hydraulic oil supply device 100 switches the valve position of the circuit switching valve 6 in accordance with a control command from the controller 7 during the movement of the body 41, thereby supplying the hydraulic oil from the fan pump 53 to the work equipment driver 4. At this time, the hydraulic oil supply device 100 adjusts the discharge amount of the fan pump 53 to control the rotation speed of the fan 51.

[1-2] Control Structure of Controller 7

Figure 2:
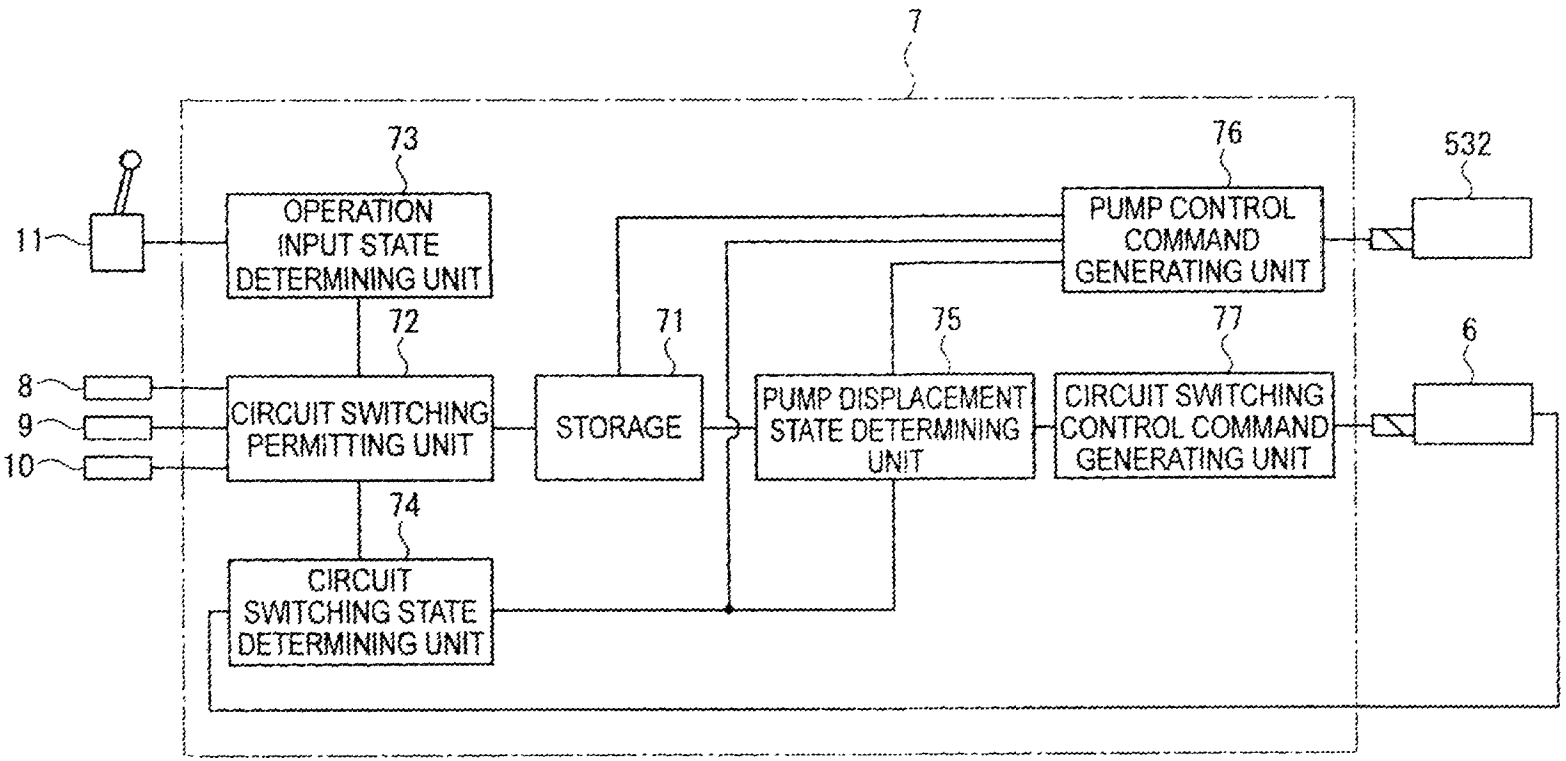
FIG. 2 is a control block diagram showing a controller that constitutes a hydraulic oil supply device according to the first exemplary embodiment.

Next, description will be made on the control structure of the controller 7 for supplying the hydraulic oil with reference to FIG. 2.

The controller 7 includes: a storage 71; a circuit switching permitting unit 72; an operation input state determining unit 73; a circuit switching state determining unit 74; a pump displacement state determining unit 75; a pump control command generating unit 76; and a circuit switching control command generating unit 77.

The storage 71 stores a reference temperature, which is an upper-limit temperature of the cooling water and the hydraulic oil at which circuit switching is permitted. In addition, the storage 71 stores an elapsed time from the time when circuit switching control starts, an elapsed time from the time when the circuit switching valve 6 gets switched, and an elapsed time from the time when a return control from the circuit-switched state starts and renews these elapsed time every operation.

The circuit switching permitting unit 72 permits circuit switching for supplying the hydraulic oil from the fan pump 53 to the steering mechanism driver 3 and the work equipment driver 4. Specifically, the circuit switching permitting unit 72 determines whether or not the circuit switching should be performed based on the detected values of the water temperature sensor 8, the oil temperature sensor 9 and the movement position detector 10 and permits switching of the circuit switching valve 6 and an accompanying displacement control of the fan pump 53.

The operation input state determining unit 73 determines the current input state of the body control lever 11 based on an operation input signal from the body control lever 11. Specifically, the operation input state determining unit 73 determines which one of the "up", "down", "float" and "hold" of the body 41 is commanded by the input state of the body control lever 11.

The circuit switching state determining unit 74 determines whether or not the circuit switching valve 6 is switched. Specifically, the circuit switching state determining unit 74 determines that the circuit switching valve 6 is not switched when energization of the solenoid of the circuit switching valve 6 is off and therefore recognizes that the hydraulic oil discharged from the fan pump 53 is used for driving the fan. On the other hand, the circuit switching state determining unit 74 determines that the circuit switching valve 6 is switched when energization of the solenoid of the circuit switching valve 6 is on and recognizes that the hydraulic oil from the fan pump 53 is supplied to the steering mechanism driver 3 and the work equipment driver 4.

The pump displacement state determining unit 75 determines the pump displacement of the fan pump 53, which varies in accordance with the driving of the displacement changer 531. Specifically, the pump displacement state determining unit 75 determines whether or not the displacement of the fan pump 53 becomes minimum, maximum or equal to a target pump displacement for driving the fan.

The pump control command generating unit 76 generates and outputs a control command to the fan pump 53 based on the presence of permission of circuit switching by the circuit switching permitting unit 72 and the results of determination of the determining units 73 to 75.

Likewise, the pump control command generating unit 77 generates and outputs a control command to the circuit switching valve 6 based on the presence of permission of circuit switching by the circuit switching permitting unit 72 and the results of determination of the determining units 73 to 75.

[1-3] Advantages of Hydraulic Oil Supply Device 100

Description will be made below on the advantages of the hydraulic oil supply device 100, particularly the advantages of the controller 7, with reference to FIGS. 3 to 6.

Figure 3:
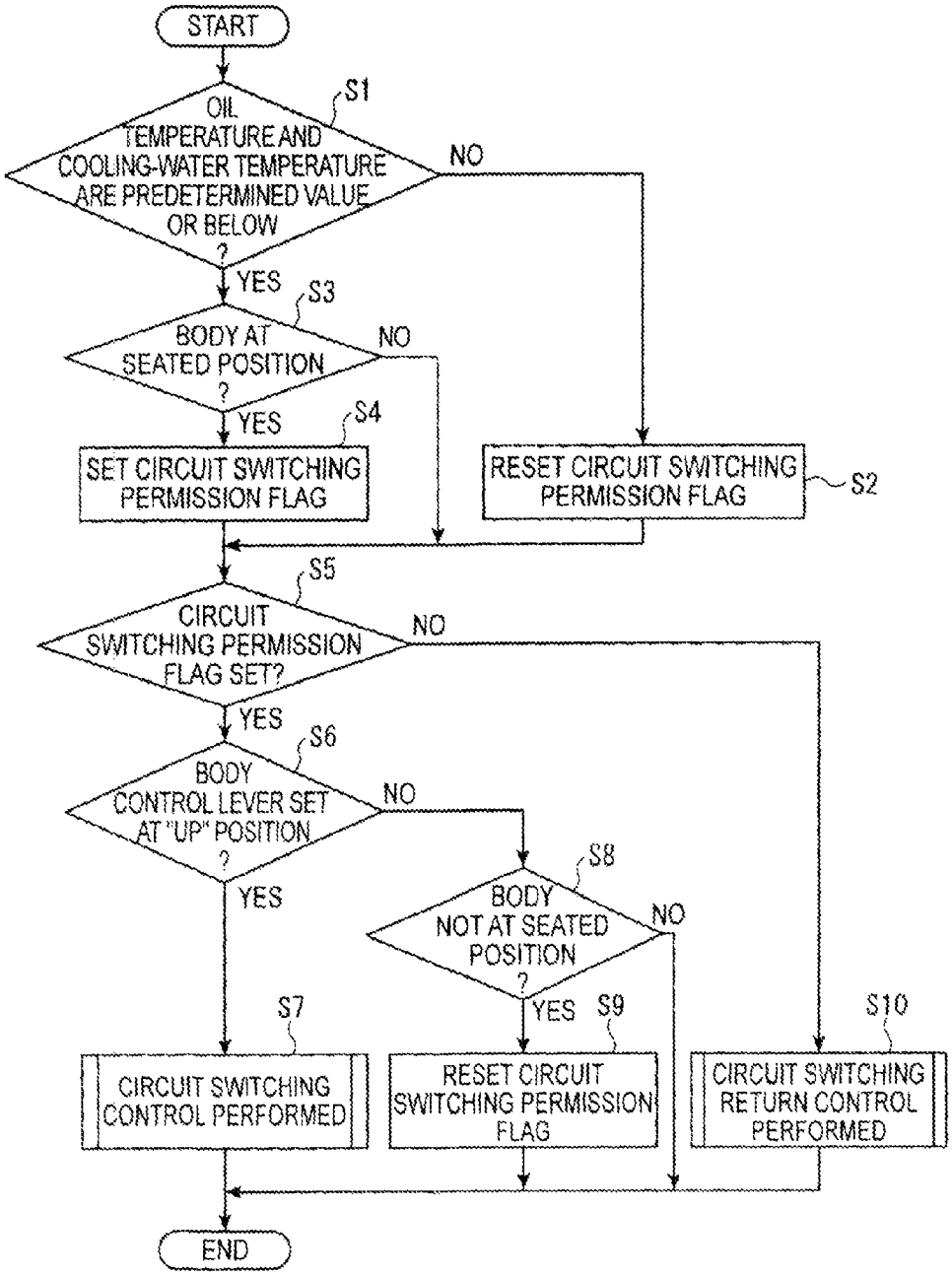
FIG. 3 is a flowchart showing a control flow of the controller according to the first exemplary embodiment.

As shown in FIG. 3, the controller 7 first reads the temperature signals, the rotation angle signal of the body 41 and the operation input signal of the body control lever 11 and then the circuit switching permitting unit 72 determines whether or not the oil temperature and the cooling-water temperature are equal to or lower than predetermined temperatures (Step S1). When it is determined that the oil temperature and the cooling-water temperature are not equal to or lower than the predetermined temperatures, a circuit switching permission flag is reset (Step S2). On the contrary, when it is determined that the oil temperature and the cooling-water temperature are equal to or lower than the predetermined temperature, the circuit switching permitting unit 72 further determines whether or not the body 41 is set at a seated position (Step S3). When it is determined that the body 41 is set at the seated position, the circuit switching permitting unit 72 sets the circuit switching permission flag (Step S4). The controller 7 determines whether or not the circuit switching permission flag is set (Step S5).

When it is determined the circuit switching permission flag is set, the operation input state determining unit 73 determines whether or not the input state of the body control lever 11 is set at an "up" state of the body 41 (Step S6). When it is determined that the body control lever 11 is set at the "up" state, the controller 7 performs the circuit switching control (Step S7). When it is determined the body control lever 11 is set at a state other than the "up" state, the controller 7 cancels the permission for position circuit switching after determining the position of the body 41. In other words, the circuit switching permitting unit 72 determines whether or not the body 41 is set at the seated position (Step S8). When it is determined that the body 41 is not set at the seated position, the circuit switching permitting unit 72 resets the circuit switching permission flag (Step S9).

Figure 4:
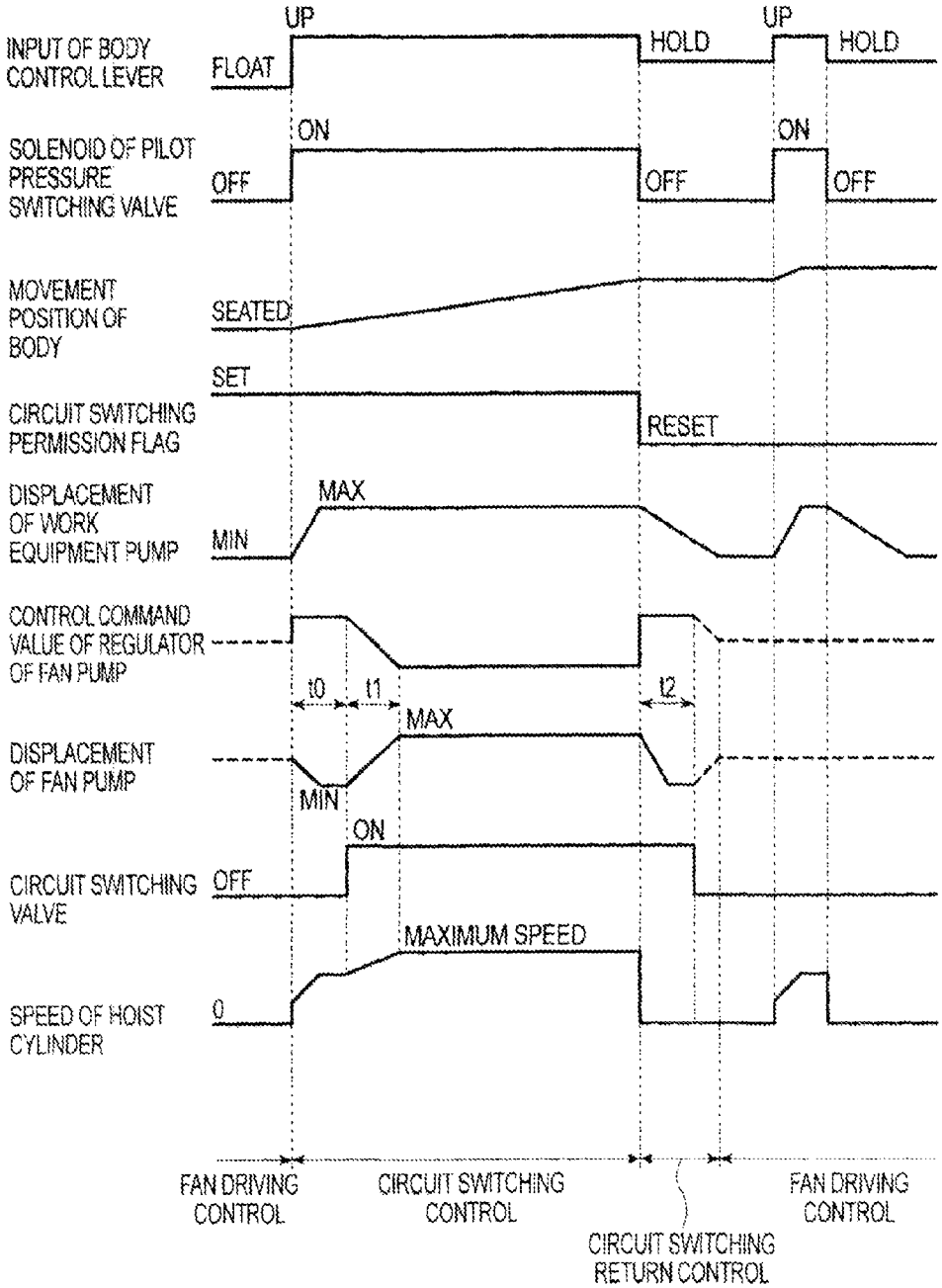
FIG. 4 is a timing chart for illustrating advantages of the hydraulic oil supply device according to the first exemplary embodiment.
Figure 5:
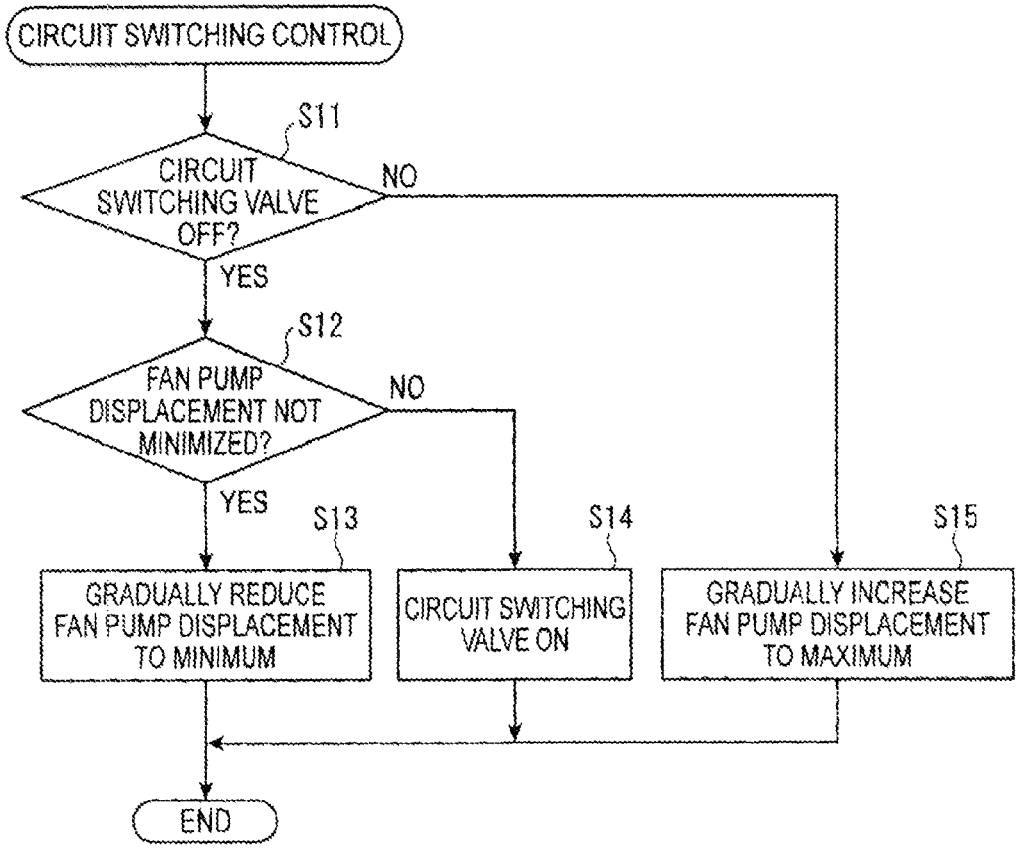
FIG. 5 is a flowchart showing the control flow of the controller according to the first exemplary embodiment.

On the other hand, when the circuit switching permission flag is not set at Step S5, the controller 7 performs the return control for returning the circuit switching to a normal state as shown also in FIG. 4.

Here, the circuit switching control of the controller 7 will be described in more detail. When the circuit switching control is performed based on the determination of the controller 7, the circuit switching state determining unit 74 determines whether or not the circuit switching valve 6 is off depending on whether or not the solenoid of the circuit switching valve 6 is energized (Step S11).

When it is determined that the circuit switching valve 6 is off (the circuit switching valve has not been switched) at Step S11, the pump displacement state determining unit 75 determines whether or not the pump displacement of the fan pump 53 is minimized (Step S12). Here, since the change rate of the pump displacement is different depending on the hardware configuration of the fan pump 53, the pump displacement may not be immediately increased as commanded depending on the type of the fan pump 53 even when the regulator 532 is commanded to drive the displacement changer 531. For this reason, according to this exemplary embodiment, as shown in FIG. 4, the storage 71 stores the elapsed time from the time when the circuit switching control starts. The pump displacement state determining unit 75 is designed to determine that the pump displacement is minimized when the elapsed time exceeds a time t0 required for minimizing the pump displacement.

Referring back to FIG. 5, when it is determined that the pump displacement is not minimized at Step S12, the pump control command generating unit 76 generates a control command for gradually reducing the pump displacement and outputs this control command to the fan pump 53 (Step S13). In this manner, as shown in FIG. 4, the pump displacement is gradually reduced and the fan pump 53 is allowed to discharge the hydraulic oil while its displacement is minimized. When it is determined that the pump displacement is minimized at Step S12 in FIG. 5, the circuit switching control command generating unit 77 generates a control command for switching the circuit switching valve 6 and outputs this control command to the circuit switching valve 6 (Step S14).

On the other hand, when it is determined that the circuit switching valve 6 is on (the circuit switching valve 6 has been switched) at Step S11, the pump control command generating unit 76 generates a control command for gradually increasing the pump displacement to the maximum and outputs this control command to the fan pump 53 (Step S15). According to this exemplary embodiment, as shown in FIG. 4, the storage 71 stores the elapsed time from the time when the circuit switching valve 6 gets switched and the pump displacement state determining unit 75 determines that the pump displacement is maximized when the elapsed time exceeds a time t1 required for maximizing the pump displacement. Incidentally, in use of a variable displacement pump, a high tendency to follow a command value is frequently shown when the pump displacement is to be increased. In the fan pump 53, when a control command to the regulator 532 is changed at a predetermined change rate, the time t1 for increasing the pump displacement from the minimum to the maximum is coincident with a time when the displacement is actually changing as shown in FIG. 4.

Figure 6:
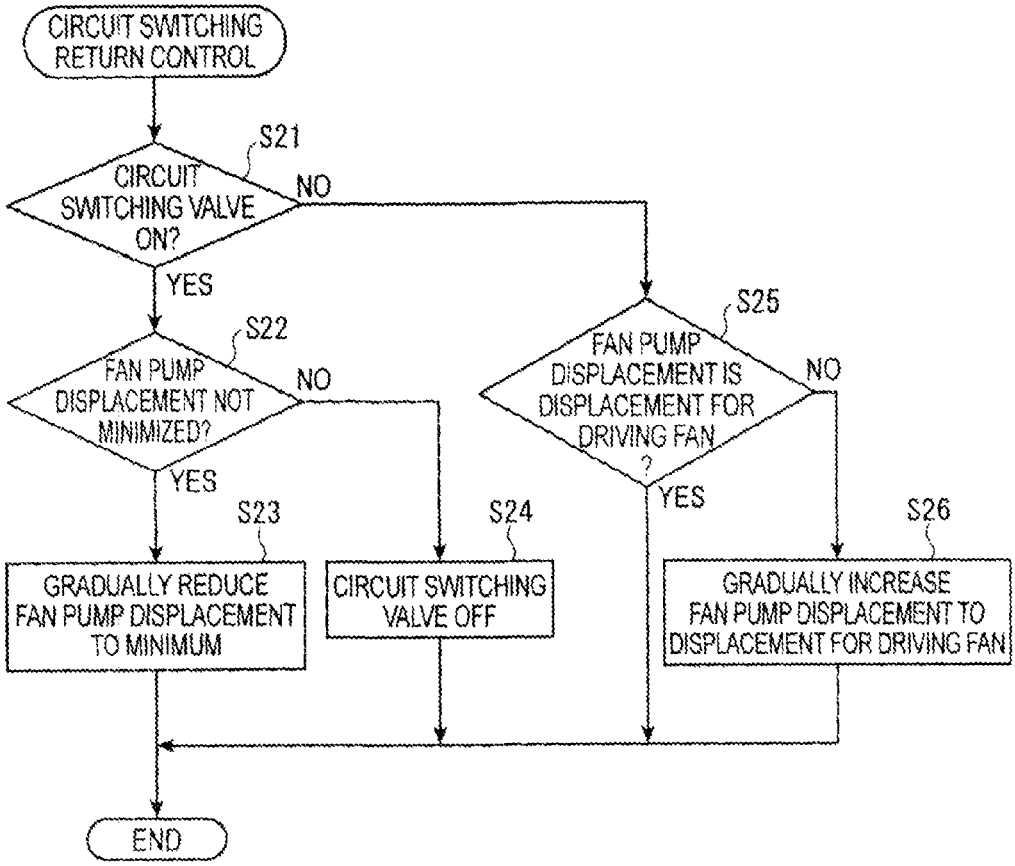
FIG. 6 is a flowchart showing the control flow of the controller according to the first exemplary embodiment.

Next, the return control from the circuit-switched state performed by the controller 7 will be described in detail. When the circuit switching return control is performed based on the determination of the controller 7, the circuit switching state determining unit 75 determines whether or not the circuit switching valve 6 is on depending on whether or not the solenoid of the circuit switching valve is energized as shown in FIG. 6 (Step S21). When it is determined that the circuit switching valve 6 is on (the circuit switching valve has been switched) at Step S21, the pump displacement state determining unit 75 determines whether or not the pump displacement of the fan pump 53 is minimized (Step S22). In other words, as shown in FIG. 4, the pump displacement state determining unit 75 stores the elapsed time from the time when the return control starts in the storage 71 and determines that the pump displacement is minimized when the elapsed time exceeds a time t2 required for minimizing the pump displacement.

Referring back to FIG. 6, when it is determined that the pump displacement is not minimized at Step S22, the pump control command generating unit 76 generates a control command for gradually reducing the pump displacement to the minimum and outputs this control command to the fan pump 53 (Step S23). When it is determined that the pump displacement is minimized at Step S22, the circuit switching control command generating unit 77 generates a control command for switching off the circuit switching valve 6 to cancel the switched state of the circuit switching valve 6 and outputs this control command to the circuit switching valve 6 (Step S24).

On the other hand, when it is determined that the circuit switching valve 6 is off (the circuit switching valve has not been switched) at Step S21, the pump displacement state determining unit 75 determines whether or not the pump displacement of the fan pump 53 is coincident with a control displacement for driving the fan (Step S25). When the pump displacement is not coincident with the control displacement for driving the fan, the pump control command generating unit 76 generates a control command for gradually increasing the pump displacement to the control displacement for driving the fan and outputs this control command to the fan pump 53 (Step S26). In this manner, the switching of the circuit switching valve 6 performed by the controller 7 and the accompanying displacement control of the fan pump 53 are completed and the fan-driving state returns to normal.

After that, as shown in FIG. 4, the circuit switching is prohibited until the body 41 returns to the seated position. Therefore, when the body 41 is not set at the seated position, the circuit is prevented from being switched even when an operator changes the input state of the body control lever 11 to the "up" state. Of course, when the body control lever 11 is frequently operated, for instance, in an operation of removing mud for which the body 41 is moved up and down at a stroke-end position on the distal side of the hoist cylinder 42.

Here, in a construction equipment, there is often provided a function for locking the position of an control lever. For instance, in the dump truck 1, when the position of the body 41 is raised to an unlocked position, so-called kick-out control is performed to automatically cancel the locked state of the body control lever 11 to return the body control lever 11 to a neutral position. Even when the kick-out control is performed while the body control lever 11 is in the locked state, since the body control lever 11 likewise returns to the neutral position, the circuit is prevented from being switched even when the body control lever 11 is operated after completion of the kick-out control.

As described above, in the hydraulic oil supply device 100 according to this exemplary embodiment, the circuit switching valve 6 is switched in accordance with the temperatures of the hydraulic oil and the cooling water, the operation position of the body control lever 11, and the movement position of the body 41 and simultaneously the discharge amount of the fan pump 53 is adjusted. In this manner, the hydraulic oil supply device 100 supplies the hydraulic oil from the fan pump 53 in addition to the hydraulic oil from the work equipment pump 21 to the hoist cylinder 42 so as to move the body 41 and prevents generation of a peak pressure in the circuit switching. Accordingly, the movement speed of the body 41 can be improved without reducing the cooling efficiency of the fan 51.

Second Exemplary Embodiment

Next, description will be made on a second exemplary embodiment of the invention with reference to FIG. 7.

In the above first exemplary embodiment, the dump truck 1 includes the steering mechanism driver 3 and the work equipment pump 21 supplies a hydraulic oil to the work equipment driver 4 and the steering mechanism driver 3.

Figure 7:
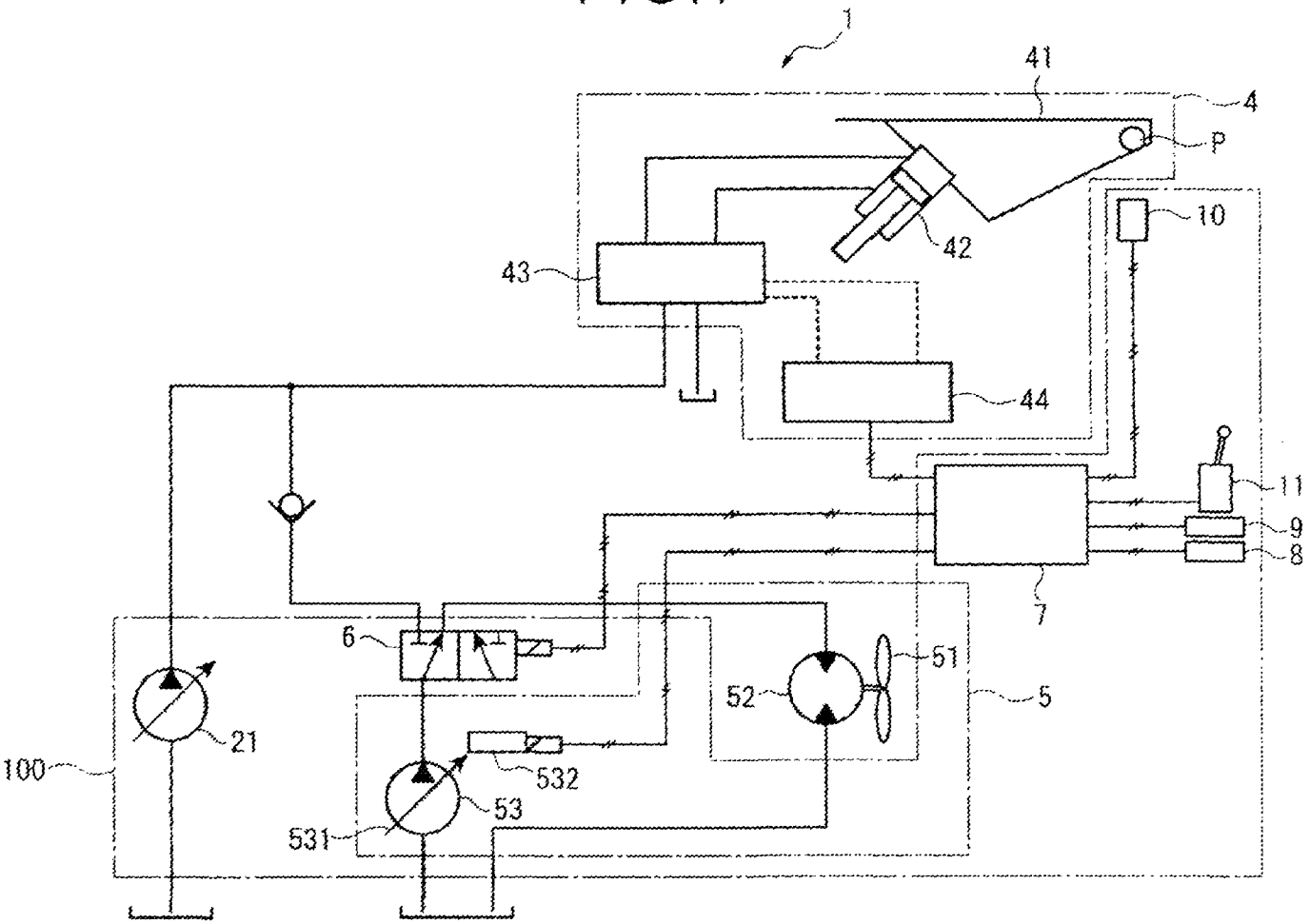
FIG. 7 is a diagram showing a structure of a construction machine according to a second exemplary embodiment of the invention.

In contrast, as shown in FIG. 7, in the second exemplary embodiment, the dump truck 1 does not include the steering mechanism driver 3, so that the operation pump 21 supplies a hydraulic oil only to the work equipment driver 4.

Specifically, the hydraulic oil supply amount adjuster 2 does not include the load-sensing valve 22, the pilot pressure switching valve 23 and priority valve 24 and the discharge-side of the work equipment pump 21 is hydraulically connected to the hoist cylinder 42.

With this arrangement, the controller 7 switches the valve position of the circuit switching valve 6 and performs the accompanying displacement control of the fan pump 53, thereby the same advantages as in the first exemplary embodiment can be attained.

Third Exemplary Embodiment

Next, description will be made on a third exemplary embodiment of the invention with reference to FIG. 8.

In the above first exemplary embodiment and second exemplary embodiment, the controller 7 performs the circuit switching when the input state of the body control lever 1 is set at the "up" state of the body 41 under the condition that the circuit switching is permitted.

In contrast, in the third exemplary embodiment, the controller 7 refers not only to the input state of the body control lever 11 but also to an accelerator pedal angle and performs the circuit switching when the input state of the body control lever 11 is set at the "up" state of the body 41 and the accelerator pedal angle is equal to or larger than a predetermined value.

Figure 8:
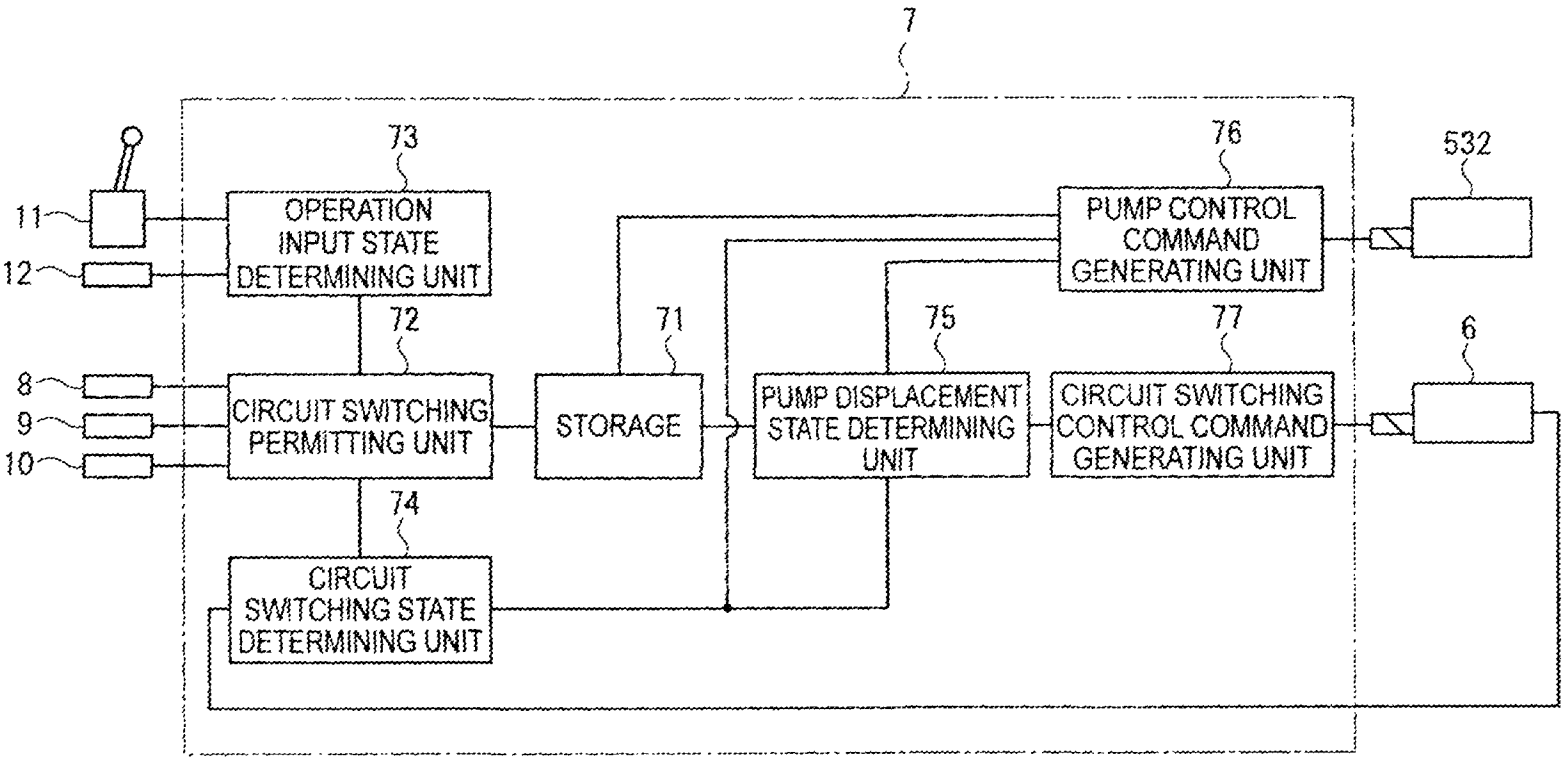
FIG. 8 is a control block diagram showing a controller that constitutes a hydraulic oil supply device according to a third exemplary embodiment.

Specifically, as shown in FIG. 8, the hydraulic oil supply device 100 according to this exemplary embodiment includes an accelerator pedal angle sensor 12 that is electrically connected to the input-side of the controller 7. The controller 7 determines an operation state input by an operator based on an operation input signal from the body control lever 11 and an accelerator pedal angle signal from the accelerator pedal angle sensor 12. Incidentally, the whole structure of the dump truck 1 according to this exemplary embodiment is obvious from FIGS. 1 and 7, and therefore a drawing thereof is omitted.

Description will be made below on the operation of the hydraulic oil supply device 100 according to this exemplary embodiment with reference to FIG. 3 used for the description of the first exemplary embodiment. The controller 7 first reads the temperature signals, the rotation angle signal of the body 41 and the operation input signal of the body control lever 11 and the accelerator pedal angle signal of the accelerator pedal angle sensor 12 and processes a circuit switching permitting flow of Steps S1 to S5 in FIG. 3. When it is determined that the circuit switching permission flag is set, the operation input state determining unit 73 determines whether or not the input state of the body control lever 11 is set at the "up" state of the body 41 and the accelerator pedal angle is equal to or larger than the predetermined value instead of performing the process of Step S6 in FIG. 3. By this determination, even when the input state of the body control lever 11 is set at the "up" state of the body 41, the circuit switching is prevented from being performed when the accelerator pedal angle is relatively small. The controller 7 performs the circuit switching control or the return control from the circuit-switched state in accordance with setting of a circuit switching permission flag by the circuit switching permitting unit 72 and the result of the determination of the operation input state determining unit 73. Incidentally, these processes are the same as those in the first exemplary embodiment and second exemplary embodiment, and therefore detailed description thereof is omitted.

As described above, the hydraulic oil supply device 100 according to this exemplary embodiment includes the accelerator pedal angle sensor 12 in addition to the components in the first exemplary embodiment and second exemplary embodiment, and therefore the accelerator pedal angle is taken into consideration to determine whether or not the circuit switching should be done. In this manner, unnecessary circuit switching is avoided, thereby effectively preventing a reduction in the cooling efficiency of the fan.

Note that the scope of the invention is not limited to the above-described embodiments, but modifications or improvements are also included in the scope of the invention as long as an object of the invention can be achieved.

For instance, the body control lever 11 is employed as a control body for controlling the movement of the work equipment in the above exemplary embodiments, but the invention is not limited thereto. The control body of the invention may be anything that serves to operate the work equipment, such as those operated by rotating a dial, pressing a pedal, or the like.

In the exemplary embodiments, the pump displacement state determining unit 75 determines that the pump displacement is minimized when the elapsed time from the time when the circuit switching control starts or the elapsed time from the time when the return control starts exceeds the time t0 or the time t2 required for minimizing the pump displacement, and determines that the pump displacement is maximized when the elapsed time from the time when the circuit switching valve 6 gets switched exceeds the time t1 required for maximizing the pump displacement, but the invention is not limited thereto. For instance, when the fan pump 53 in which the displacement changer 531 has a high tendency to follow a command to the regulator 532, so that the pump displacement is immediately increased to as commanded is used, it is determined that the pump displacement is minimized when the movement position of the displacement changer 531 (specifically the inclination angle of the swash plate) is minimized, and determined that the pump displacement is maximized when the inclination angle of the swash plate is maximized.

In the third exemplary embodiment, the circuit switching is performed based on the operation input signal from the body control lever 11 and the accelerator pedal angle signal from the accelerator pedal angle sensor 12, but the invention is not limited thereto. Accordingly, for instance, an engine speed sensor is provided in place of the accelerator pedal angle sensor 12 to perform the circuit switching when the input state of the body control lever 11 is set at the "up" state of the body 41 and the engine speed is equal to or greater than a predetermined value. When an operator presses down on the accelerator to increase the movement speed of the work equipment, the engine speed is also increased, so that the circuit switching determination can be performed by using the engine speed in the same manner as that using the accelerator pedal angle. Accordingly, in such a case, the same advantages as in the third exemplary can be attained.

In the above exemplary embodiments, a variable displacement hydraulic pump is employed as the work equipment pump 21, but the invention is not limited thereto. Accordingly, for instance, a fixed displacement hydraulic pump may be employed. In the above exemplary embodiments, though the hoist cylinder 42 is employed as the hydraulic actuator for driving the work equipment, a different hydraulic actuator such as a hydraulic motor may alternatively be used. In the above exemplary embodiments, the invention is applied to the dump truck but not limited thereto. Accordingly, the invention may be applied to other kinds of construction equipment, such as a wheel loader, a bulldozer and an excavator.

The invention claimed is:

1. A hydraulic oil supply device installed in a construction machine to supply hydraulic oil, the hydraulic oil supply device comprising:

a work equipment pump that supplies the hydraulic oil to a hydraulic actuator that drives the work equipment;

a fan pump that supplies the hydraulic oil to one of the hydraulic actuator and a hydraulic motor that drives a cooling fan;

a control valve that controls a supply of the hydraulic oil from the work equipment pump to the hydraulic actuator;

a circuit switching valve that selectively connects a discharge portion of the fan pump to the hydraulic actuator and the hydraulic motor;

a control body for operating a movement of the control valve, the control body being configured to generate an operation signal output based upon being operated by a user to control the work equipment;

a movement position detector for detecting a movement position of the work equipment, the movement position detector being configured to output a detection signal based upon detecting the movement position of the work equipment; and a controller configured to receive the operation signal output from the control body and the detection signal from the movement position detector and configured to switch the circuit switching valve based on the operation signal output and the detection signal, wherein based on receiving the operation signal output and the detection signal, the controller switches the circuit switching valve, and the hydraulic actuator receives hydraulic oil discharged from the fan pump in addition to receiving hydraulic oil discharged from the work equipment pump.

2. The hydraulic oil supply device according to claim 1, wherein the controller switches the circuit switching valve after minimizing a pump displacement of the fan pump.

3. The hydraulic oil supply device according to claim 1, further comprising a temperature sensor that detects at least one of temperatures of the hydraulic oil and a cooling water, wherein the controller prohibits switching of the circuit switching valve based on a detection signal of the temperature sensor and the detection signal of the movement position detector.

4. The hydraulic oil supply device according to claim 2, further comprising a temperature sensor that detects at least one of temperatures of the hydraulic oil and a cooling water, wherein the controller prohibits switching of the circuit switching valve based on a detection signal of the temperature sensor and the detection signal of the movement position detector.

5. The hydraulic oil supply device according to claim 1, further comprising an accelerator pedal angle sensor that detects an accelerator pedal angle for operating an output of an engine, wherein the controller switches the circuit switching valve based on the operation signal of the control body, the detection signal of the movement position detector, and a detection signal of the accelerator pedal angle sensor.

6. The hydraulic oil supply device according to claim 1, further comprising an engine speed sensor that detects an engine speed, wherein the controller switches the circuit switching valve based on the operation signal of the control body, the detection signal of the movement position detector, and a detection signal of the engine speed sensor.

7. The hydraulic oil supply device according to claim 1, wherein the movement position detector includes means for detecting the movement position of the work equipment.

8. A construction machine comprising:

a hydraulic actuator that drives a work equipment of the construction machine;

a hydraulic motor that drives a cooling fan; and a hydraulic oil supply device installed in the construction machine to supply hydraulic oil, the hydraulic oil supply device comprising:

a work equipment pump that supplies the hydraulic oil to the hydraulic actuator that drives the work equipment;

a fan pump that supplies the hydraulic oil to one of the hydraulic actuator and the hydraulic motor that drives the cooling fan;

a control valve that controls a supply of the hydraulic oil from the work equipment pump to the hydraulic actuator;

a circuit switching valve that selectively connects a discharge portion of the fan pump to the hydraulic actuator and the hydraulic motor;

a control body for operating a movement of the control valve, the control body being configured to generate an operation signal output based upon being operated by a user to control the work equipment;

a movement position detector for detecting a movement position of the work equipment, the movement position detector being configured to output a detection signal based upon detecting the movement position of the work equipment; and a controller configured to receive the operation signal output from the control body and the detection signal from the movement position detector and configured to switch the circuit switching valve based on the operation signal output and the detection signal, wherein based on receiving the operation signal output and the detection signal, the controller switches the circuit switching valve, and the hydraulic actuator receives hydraulic oil discharged from the fan pump in addition to receiving hydraulic oil discharged from the work equipment pump.

9. The construction machine according to claim 8, wherein the hydraulic oil supply device further includes:

an accelerator pedal angle sensor that detects an accelerator pedal angle for operating an output of an engine, wherein the controller switches the circuit switching valve based on the operation signal of the control body, the detection signal of the movement position detector, and a detection signal of the accelerator pedal angle sensor.

10. The construction machine according to claim 8, wherein the hydraulic oil supply device further includes:

an engine speed sensor that detects an engine speed, wherein the controller switches the circuit switching valve based on the operation signal of the control body, the detection signal of the movement position detector, and a detection signal of the engine speed sensor.

11. The construction machine according to claim 8, wherein the movement position detector includes means for detecting the movement position of the work equipment.

12. A hydraulic oil supply device installed in a construction machine to supply hydraulic oil, the hydraulic oil supply device comprising:

a work equipment pump that supplies the hydraulic oil to a hydraulic actuator that drives the work equipment;

a fan pump that supplies the hydraulic oil to one of the hydraulic actuator and a hydraulic motor that drives a cooling fan;

a control valve that controls a supply of the hydraulic oil from the work equipment pump to the hydraulic actuator;

a circuit switching means for selectively connecting a discharge portion of the fan pump to the hydraulic actuator and the hydraulic motor;

a control body for operating a movement of the control valve, the control body being configured to generate an operation signal output based upon being operated by a user to control the work equipment;

a movement position detector for detecting a movement position of the work equipment, the movement position detector being configured to output a detection signal based upon detecting the movement position of the work equipment; and a controller configured to receive the operation signal output from the control body and the detection signal from the movement position detector and configured to switch the circuit switching means based on the operation signal output and the detection signal, wherein based on receiving the operation signal output and the detection signal, the controller switches the circuit switching means, and the hydraulic actuator receives hydraulic oil discharged from the fan pump in addition to receiving hydraulic oil discharged from the work equipment pump.

13. The hydraulic oil supply device according to claim 12, wherein the controller switches the circuit switching means after minimizing a pump displacement of the fan pump.

14. The hydraulic oil supply device according to claim 13, further comprising a temperature sensor that detects at least one of temperatures of the hydraulic oil and a cooling water, wherein the controller prohibits switching of the circuit switching means based on a detection signal of the temperature sensor and the detection signal of the movement position detector.

15. The hydraulic oil supply device according to claim 12, further comprising a temperature sensor that detects at least one of temperatures of the hydraulic oil and a cooling water, wherein the controller prohibits switching of the circuit switching means based on a detection signal of the temperature sensor and the detection signal of the movement position detector.

16. The hydraulic oil supply device according to claim 12, further comprising an accelerator pedal angle sensor that detects an accelerator pedal angle for operating an output of an engine, wherein the controller switches the circuit switching means based on the operation signal of the control body, the detection signal of the movement position detector, and a detection signal of the accelerator pedal angle sensor.

17. The hydraulic oil supply device according to claim 12, further comprising an engine speed sensor that detects an engine speed, wherein the controller switches the circuit switching means based on the operation signal of the control body, the detection signal of the movement position detector, and a detection signal of the engine speed sensor.

18. The hydraulic oil supply device according to claim 12, wherein the movement position detector includes means for detecting the movement position of the work equipment.

* * * * *